US007587845B1

(12) United States Patent
Perez

(10) Patent No.: US 7,587,845 B1
(45) Date of Patent: Sep. 15, 2009

(54) NAUTICAL SIGN

(76) Inventor: Edwin Perez Perez, 2370 SW. 127th Ave., Miramar, FL (US) 33027

( * ) Notice: Subject to any disclaimer, the term of this patent is extended or adjusted under 35 U.S.C. 154(b) by 17 days.

(21) Appl. No.: 12/072,467

(22) Filed: Feb. 26, 2008

(51) Int. Cl.
*G09F 13/20* (2006.01)

(52) U.S. Cl. ..... 40/542; 40/582; 40/557; 359/535

(58) Field of Classification Search ..... 40/542, 40/582, 583, 544, 557, 612, 615; 359/527, 359/530–532, 535, 542, 551–552; 362/84, 362/812
See application file for complete search history.

(56) References Cited

U.S. PATENT DOCUMENTS 3,254,563 A * 6/1966 De Vries et al. ..... 359/539
3,766,881 A * 10/1973 Ward ..... 116/63 P
5,243,457 A * 9/1993 Spencer ..... 119/795
5,415,911 A * 5/1995 Zampa et al. ..... 428/41.8
6,656,566 B1 12/2003 Kuykendall et al.
7,166,369 B2 * 1/2007 Sturley ..... 428/690
7,414,775 B2 * 8/2008 Tam et al. ..... 359/296

* cited by examiner

*Primary Examiner*—Lesley D Morris
*Assistant Examiner*—Shin Kim
(74) *Attorney, Agent, or Firm*—Craig Kirsch; Ruben Alcoba

(57) ABSTRACT

A nautical sign with reflective and photoluminescent qualities that is used to enhance the safety of nautical travelers on waterways in conditions where visibility is limited. The nautical sign comprises a front rigid sheet having an upper surface and a lower surface, a back rigid sheet having an upper surface and a lower surface, alternating layers of round reflective disks having an upper surface and a lower surface and a photoluminescent film having an upper surface and a lower surface. The alternating layers of round reflective disks and photoluminescent film are contained in between the front rigid sheet and the back rigid sheet. When a light source is shown on the nautical sign, a portion of the light is reflected by the reflective disks and the photoluminescent film is activated resulting in heightened visibility of the nautical sign.

19 Claims, 4 Drawing Sheets

NAUTICAL SIGN

BACKGROUND

The present invention is a nautical sign with reflective and photoluminescent qualities that is used to enhance the safety of nautical travelers on waterways in conditions where visibility is limited.

The inventor conceived the present invention while on duty as a vessel operator with the United States Customs and Border Protection. As a vessel operator with the United States Customs and Border Protection, the inventor has spent countless hours navigating various waterways during a myriad of weather conditions and particularly the inventor has navigated waterways throughout the spectrum of visible light associated with the different locales, seasons, and time of day of the waterways of the United States and its territories.

In order for nautical travelers to safely navigate the waterways of the United States and its territories, a system known as the U.S. Aids to Navigation System has been employed by the United States Coast Guard. This system comprises a simple arrangement of colors, shapes, numbers, and light characteristics to mark navigable channels, waterways, as well as the known obstructions in the bodies of water. This system can provide a nautical traveler with the same type of information an automobile driver obtains from street signs, stop signals, road barriers, detour signs and traffic signals.

After more than 20 years of navigating various waterways, as a vessel operator with the United States Customs and Border Protection, the inventor has observed that the existing aids to navigation, specifically the Daybeacon (a non-lighted nautical sign permanently affixed to the earth's surface), is effective in ideal conditions, i.e. sunny, dry, conditions with good visibility, but is less effective in conditions with limited visibility, namely foggy conditions or other conditions where there is limited daylight.

A navigation aid that cannot be seen is as effective as not having an aid, for it does not convey the intended safety information to the nautical travelers on the waterways. Failing to convey the intended safety information to nautical travelers can have disastrous results including property damage, severe injury and even death.

As a vessel operator with the United States Customs and Border Protection, the inventor has witnessed accident scenes that resulted from nautical travelers failing to see Daybeacons. After witnessing such horrors, the inventor realized that an improvement to the existing signage used to navigate the waterways is desperately needed.

Throughout his years as a vessel operator with the United States Customs and Border Protection, the inventor has navigated waterways at night using the "stand and shine" method. This method essentially consists of a procedure where a nautical traveler stands up while navigating his vessel and shines a light into the open waters and searches for reflective beacons to serve as indications of the navigable waterways. The problems with this method are obvious. Firstly, if the nautical traveler is alone, it is difficult to stand, shine, locate, and navigate the vessel all at the same time. Secondly, the reflective beacon only serves as a navigation aid as long as the light is shined in the beacons' direction and the moment the light is no longer shining on the reflective beacon, it effectively ceases to exist. As stated above, horrors may result if the nautical traveler cannot distinguish information from the navigational aids.

After years of navigating the waterways of the United States and its territories in conditions of limited visibility using the "stand and shine" method, the inventor realized that a Daybeacon with both reflective and photoluminescent qualities would enhance the safety of nautical travelers navigating the waterways of the United States and its territories.

The inventor realized that incorporating a photoluminescent element into the conventional Daybeacon would eliminate the need for the constant shining inherent in the "stand and shine" method because once the Daybeacon is located with a light source, the photoluminescent element of the current invention would remain illuminated thereby providing the nautical travelers with the much needed information from the Daybeacon in a safer, longer lasting manner than that which the conventional Daybeacon can offer.

An objective of the present invention is to provide a navigation aid to nautical travelers that is visible in less than ideal conditions.

Another objective of the present invention is to provide a navigation aid to nautical travelers that remains illuminated after the light source has been removed.

Yet another objective of the present invention is to provide a navigation aid that reduces the dangers associated with the "stand and shine" method of navigating waterways in less than ideal visibility conditions.

Information relevant to attempts to address these objectives can be found in U.S. Pat. No. 5,243,457 and U.S. Pat. No. 6,656,566 B1. However, each one of these references suffers from one or more of the following disadvantages: the references do not provide for the photoluminescent element to be activated from multiple directions, the references do not provide for a protective means for longevity of the invention and the references do not provide for photoluminescent element that is translucent.

For the foregoing reasons, there is a need for a nautical sign with reflective and photoluminescent qualities that is used to enhance the safety of nautical travelers on waterways in conditions where visibility is limited.

SUMMARY

The present invention is directed to a nautical sign with reflective and photoluminescent qualities that is used to enhance the safety of nautical travelers on waterways in conditions where visibility is limited.

The nautical sign has a front rigid sheet and a back rigid sheet. Alternating layers of round reflective disks and photoluminescent film are contained in between the front rigid sheet and the back rigid sheet. When a light source is shown on the nautical sign, a portion of the light is reflected by the reflective disks and the photoluminescent film is activated resulting in heightened visibility of the nautical sign.

The present invention solves the need for a nautical sign with reflective and photoluminescent qualities that is used to enhance the safety of nautical travelers on waterways in conditions where visibility is limited.

DRAWINGS

These and other features, aspects, and advantages of the present invention will become better understood with regard to the following description, appended claims and drawings where:

DESCRIPTION

Figure 3:
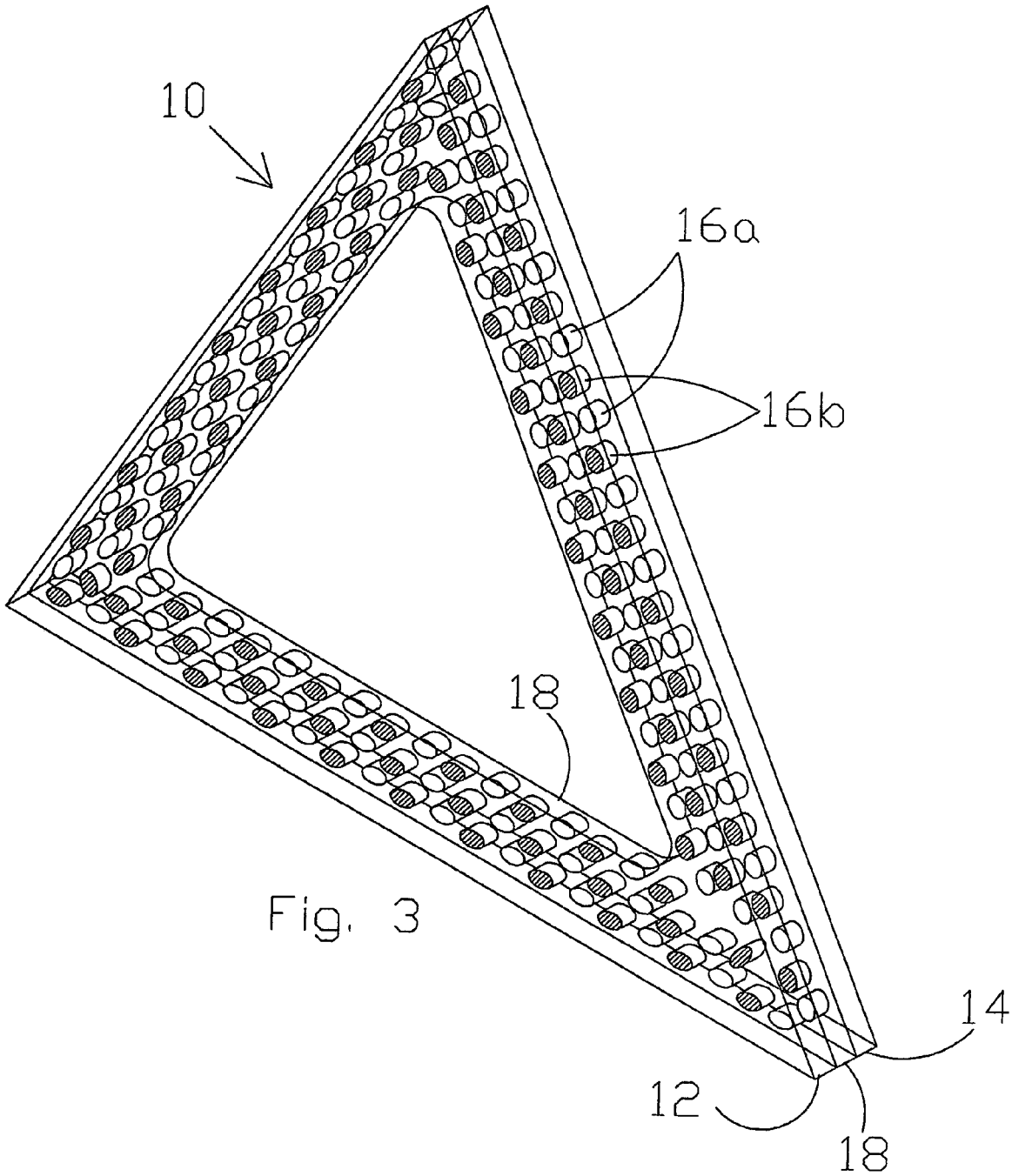
FIG. 3 shows a perspective view of one embodiment of the present invention.
Figure 4:
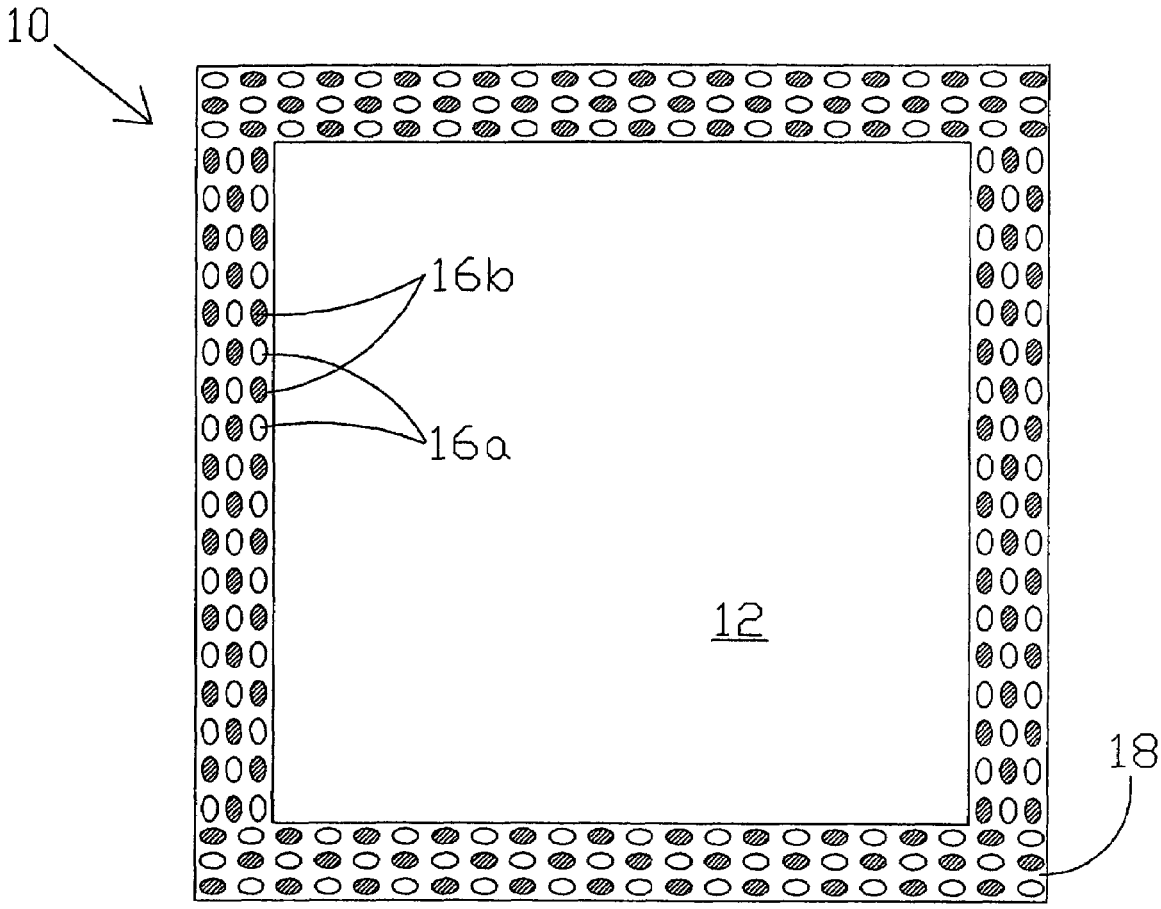
FIG. 4 shows a front side view of another embodiment of the present invention.
Figure 5:
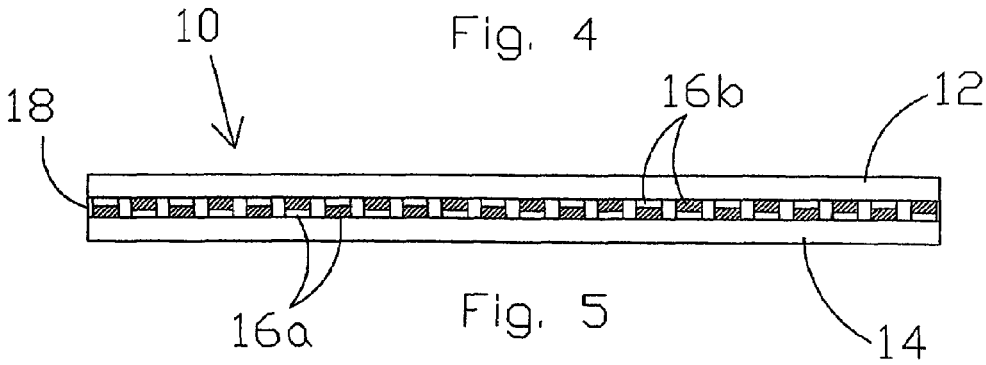
FIG. 5 shows a cross section view of another embodiment of the present invention.
Figure 6:
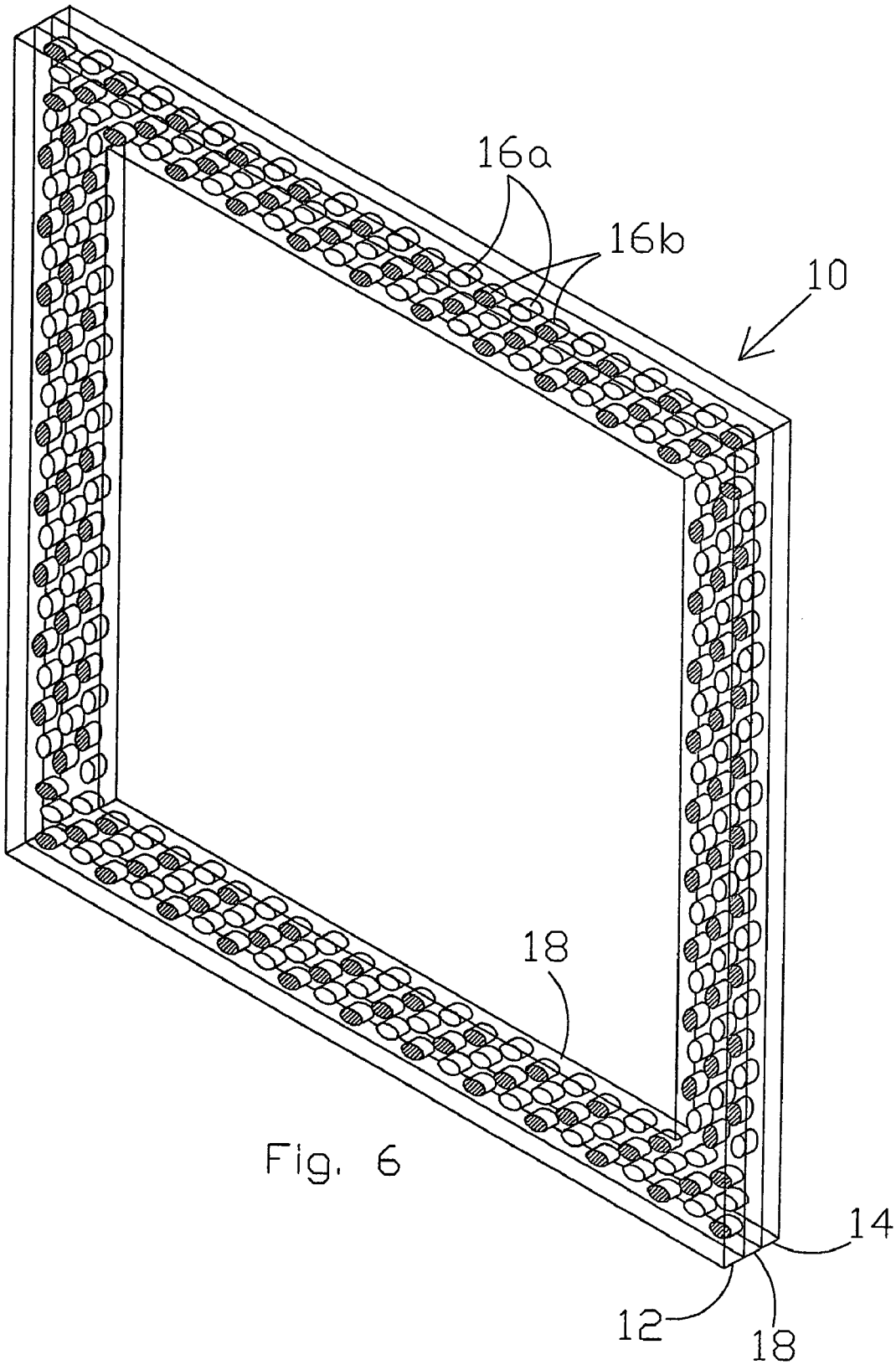
FIG. 6 shows a perspective view of one embodiment of the present invention.

As shown in FIG. 3, a nautical sign 10, comprising a front rigid sheet 12 having an upper surface and a lower surface and a back rigid sheet 14 having an upper surface and a lower surface, a first plurality of reflective disks 16*a* having an upper surface and a lower surface, a second plurality of reflective disks 16*b* having an upper surface and a lower surface and a photoluminescent film 18 having an upper surface and a lower surface.

The lower surface of the first plurality of reflective disks 16*a* contacts the upper surface of the back rigid sheet 14. The first plurality of reflective disks 16*a* might be made of any material that reflects light when a light source is shown upon it. The first plurality of reflective disks 16*a* might be positioned along the upper surface of the back rigid sheet 14 in a staggered manner such that a semi-opaque layer is formed with space in between each of the first plurality of reflective disks 16*a*.

The lower surface of the photoluminescent film 18 contacts the upper surface of the first plurality of reflective disks 16*a* staggered along the upper surface of the back rigid sheet 14. The photoluminescent film 18 might be made of any material that absorbs photons when a light source is shown upon it and produces visible light for a period of time when the light source is removed.

The lower surface of the second plurality of reflective disks 16*b* contacts the upper surface of the photoluminescent film 18. The second plurality of reflective disks 16*b* might be positioned along the upper surface of the photoluminescent film 18 in a staggered manner opposite the staggered manner that the first plurality of reflective disks 16*a* are placed along the upper surface of the back rigid sheet 14. The resulting placement of the first plurality of the reflective disks 16*a* and the second plurality of reflective disks 16*b* is such that when viewed from either above the top rigid sheet 12 or from below the bottom rigid sheet 14 the reflective material and photoluminescent material is in an alternating sequence.

The top of the second plurality of reflective disks 16*b* contacts the lower surface of the front rigid sheet 12.

The front rigid sheet 12 is fixedly attached to the back rigid sheet 14 by a fastener whereby said fastener may be a screw, nut and bolt assembly or other suitable means for fastening.

Figure 1:
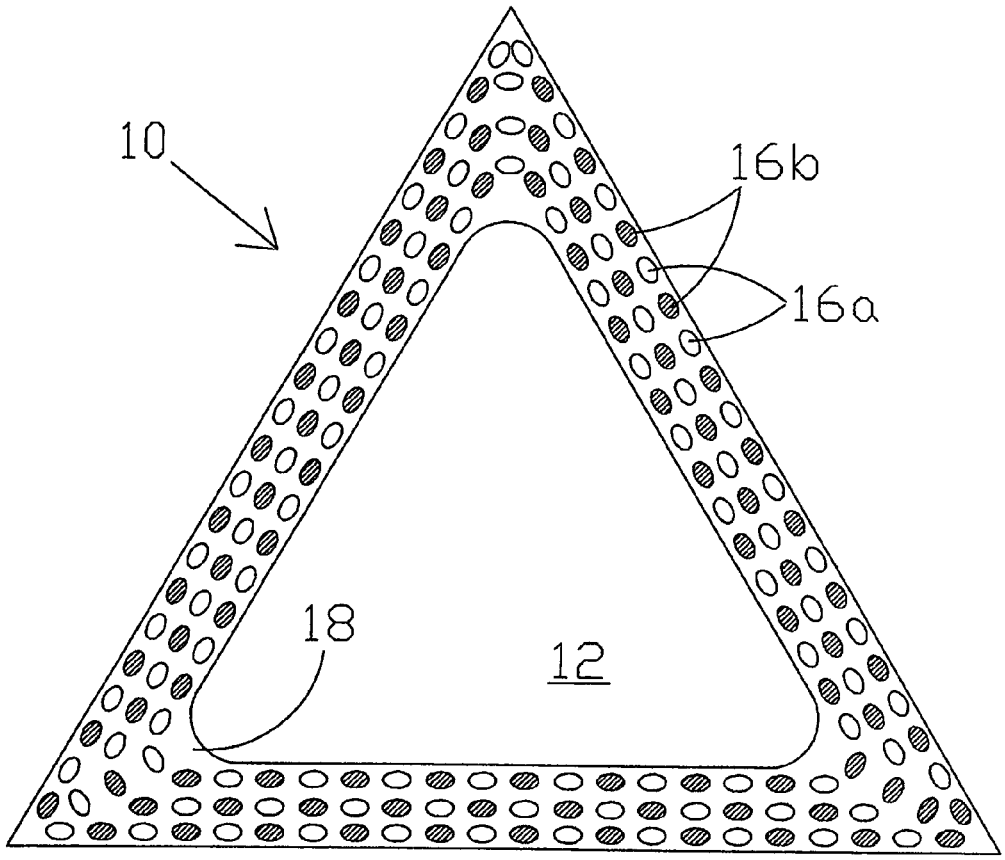
FIG. 1 shows a front side view of one embodiment of the present invention.
Figure 2:
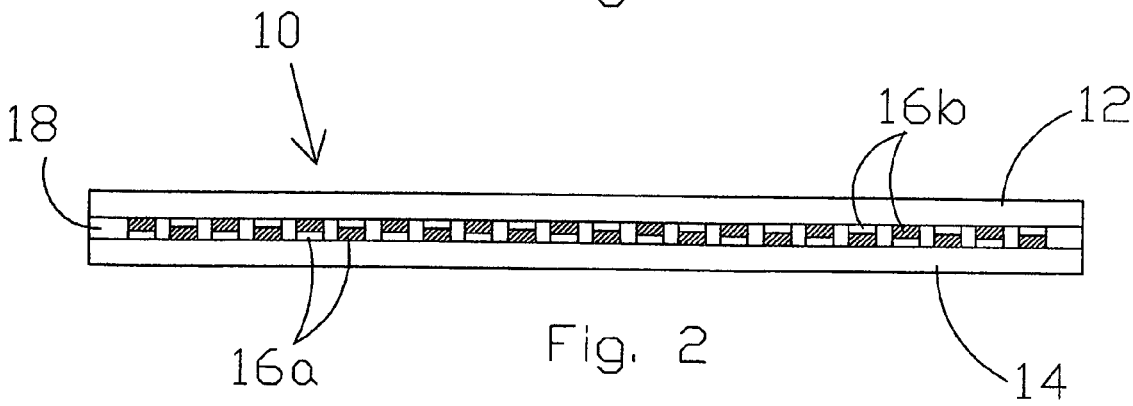
FIG. 2 shows a cross section view of one embodiment of the present invention.

As seen in FIG. 1 one embodiment of the nautical sign comprises a front rigid sheet 12 and a back rigid sheet 14 that are triangular in shape.

As seen in FIG. 3 another embodiment of the nautical sign comprises a front rigid sheet 12 and a back rigid sheet 14 that are square in shape.

The nautical sign of the present invention is made of materials known in the art of sign making.

The present invention is made using techniques known in the art of sign making.

The nautical sign of the present invention must be fixedly attached coplanar to the front rigid sheet 12 and a back rigid sheet 14 to a solid elongated member preferably made of a heavy metal. The opposite end of the elongated member made of heavy metal must be permanently affixed to the earth's surface.

The present invention is used by shining a light source upon it. While the light source is shown upon the nautical sign 10, a portion of the light is reflected by the first plurality of reflective disks 16*a* or the second plurality of reflective disks 16*b*, depending on which direction the light is shown. While the light source is shown upon the nautical sign 10, the photoluminescent film 18 absorbs some of the photons from the light source. When the light source is removed, the photoluminescent film 18 remains illuminated for a period of time. The combination of the reflective qualities of the first plurality of reflective disks 16*a* or the second plurality of reflective disks 16*b* and the photoluminescent quality of the photoluminescent film 18 provide enhanced visibility of the nautical sign 10.

An advantage of the present invention is that it provides nautical travelers with enhanced visibility of navigational aids.

Another advantage of the present invention is that it reduces the need for nautical travelers to locate navigational aids using the traditional "stand and shine" method.

Yet another advantage of the present invention is that the enclosed front rigid sheet 12 and a back rigid sheet 14 provide for a longer lasting, weather resistant nautical sign.

Although the present invention has been described in considerable detail with reference to certain preferred versions thereof, other versions are possible. Therefore, the spirit and the scope of the claims should not be limited to the description of the preferred versions contained herein.

What is claimed is:

1. A nautical sign having reflective and luminescent qualities which comprises:

a front rigid sheet having an upper surface and a lower surface;

a first retroreflective layer comprising a first plurality of reflective disks having an upper surface and a lower surface, the first retroreflective layer is positioned such that the upper surface of the first plurality of reflective disks of the first retroreflective layer contacts the lower surface of the front rigid sheet;

a luminescent layer comprising a photoluminescent film having an upper surface and a lower surface, wherein the photoluminescent film absorbs photons from a light source and remains glowing when the light source is removed, the luminescent layer is positioned such that the upper surface of the photoluminescent film contacts the lower surface of the first plurality of reflective disks of the first retroreflective layer;

a second retroreflective layer comprising a second plurality of reflective disks having an upper surface and a lower surface, the second retroreflective layer is positioned such that the upper surface of the second plurality of reflective disks of the second retroreflective layer contacts the lower surface of the photoluminescent film; and a back rigid sheet having an upper surface and a lower surface, the back rigid sheet is positioned such that the upper surface of the back rigid sheet contacts the lower surface of the second plurality of reflective disks of the second retroreflective layer.

2. The sign of claim 1, wherein the first plurality of reflective disks of the first retroreflective layer are positioned in a staggered configuration.

3. The sign of claim 2, wherein the second plurality of reflective disks of the second retroreflective layer are positioned in a staggered configuration opposite the staggered configuration of the first plurality of reflective disks of the first retroreflective layer.

4. The sign of claim 2 wherein the staggered first plurality of reflective disks of the first retroreflective layer and the staggered second plurality of reflective disks of the second retroreflective layer are configured in such a manner as to create a semi-opaque layer, whereby the curvature between the union of the plurality of disks creates an opening so that the photoluminescent film might be seen through the opening.

5. The sign of claim 1, wherein the front rigid sheet is translucent.

6. The sign of claim 1, wherein the photoluminescent film is translucent.

7. The sign of claim 1, wherein the back rigid sheet is translucent.

8. The sign of claim 1, wherein the front rigid sheet and the back rigid sheet are triangular in shape.

9. The sign of claim 8, wherein the photoluminescent film glows red when the light source is removed.

10. The sign of claim 1, wherein the front rigid sheet and the back rigid sheet are square in shape.

11. The sign of claim 10, wherein the photoluminescent film glows green when the light source is removed.

12. A nautical sign having reflective and luminescent qualities which comprises:

a front rigid translucent sheet in a governmentally approved shape for maritime signage, having an upper surface and a lower surface;

a first retroreflective layer comprising a first plurality of reflective disks having an upper surface and a lower surface, wherein the first plurality of reflective disks of the first retroreflective layer are positioned in a staggered configuration, the first retroreflective layer is positioned such that the upper surface of the first plurality of reflective disks of the first retroreflective layer contacts the lower surface of the front rigid sheet;

a translucent luminescent layer comprising a translucent photoluminescent film having an upper surface and a lower surface that glows when the light source is removed, the luminescent layer is positioned such that the upper surface of the photoluminescent film contacts the lower surface of the plurality of reflective disks of the first retroreflective layer;

a second retroreflective layer comprising a second plurality of reflective disks having an upper surface and a lower surface, wherein the second plurality of reflective disks of the second retroreflective layer are positioned in a staggered configuration opposite the staggered configuration of the first plurality of reflective disks of the first retroreflective layer and the staggered first plurality of reflective disks of the first retroreflective layer and the second plurality of reflective disks of the second retroreflective layer are configured in such a manner as to create a semi-opaque layer, whereby the curvature between the union of the plurality of disks creates an opening so that the photoluminescent film might be seen through the opening, the second retroreflective layer is positioned such that the upper surface of the second plurality of reflective disks of the second retroreflective layer contacts the lower surface of the photoluminescent film; and a back rigid translucent sheet in a governmentally approved shape for maritime signage, having an upper surface and a lower surface, the back rigid sheet is positioned such that the upper surface of the back rigid sheet contacts the lower surface of the second plurality of reflective disks of the second retroreflective layer.

13. The nautical sign of claim 12 wherein the front rigid translucent sheet is triangular in shape.

14. The nautical sign of claim 12 wherein the back rigid translucent sheet is triangular in shape.

15. The nautical sign of claim 12 wherein the photoluminescent film glows red when the light source is removed.

16. The nautical sign of claim 12 wherein the front rigid translucent sheet is square in shape.

17. The nautical sign of claim 12 wherein the back rigid translucent sheet is square in shape.

18. The nautical sign of claim 12 wherein the wherein the photoluminescent film glows red when the light source is removed.

19. A method of making a nautical sign comprising of steps of:

Providing a back rigid sheet having an upper surface and a lower surface;

Positioning a first retroreflective layer comprising a first plurality of reflective disks having an upper surface and lower surface in a staggered configuration such that the lower surface of the first retroreflective layer is in contact with the upper surface of the back rigid sheet;

Applying a layer of photoluminescent film to the upper surface of the first retroreflective layer, wherein the photoluminescent film absorbs photons from a light source and remains glowing when the light source is removed;

Positioning a second retroreflective layer comprising a second plurality of reflective disks having an upper surface and a lower surface in a staggered configuration opposite the staggered configuration of the first retroreflective layer such that the lower surface of the second retroreflective layer is in contact with the lower surface of the photoluminescent film;

Positioning a front rigid sheet, having an upper surface and a lower surface in such a manner that the lower surface of the front rigid sheet is in contact with the upper surface of the second retroreflective layer; and Fixedly attaching the back rigid sheet, the first retroreflective layer, the photoluminescent film, the second retroreflective layer, and the front rigid sheet using fasteners such as screws, nuts, and bolts, or the like.

* * * * *